US009219302B2

(12) United States Patent
Jenwatanavet

(10) Patent No.: US 9,219,302 B2
(45) Date of Patent: Dec. 22, 2015

(54) COMPACT ANTENNA SYSTEM

(75) Inventor: Jatupum Jenwatanavet, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 564 days.

(21) Appl. No.: 13/594,571

(22) Filed: Aug. 24, 2012

(65) Prior Publication Data

US 2014/0055309 A1 Feb. 27, 2014

(51) Int. Cl.

| | |
|---|---|
| ***H01Q 21/00*** | (2006.01) |
| ***H01Q 1/24*** | (2006.01) |
| ***H01Q 5/01*** | (2006.01) |
| ***H01Q 1/38*** | (2006.01) |
| ***H01Q 1/27*** | (2006.01) |
| ***H01Q 9/42*** | (2006.01) |
| ***H01Q 21/28*** | (2006.01) |
| ***H01Q 5/371*** | (2015.01) |

(52) U.S. Cl.

CPC ..... *H01Q 1/273* (2013.01); *H01Q 5/371* (2015.01); *H01Q 9/42* (2013.01); *H01Q 21/28* (2013.01)

(58) Field of Classification Search

CPC ..... H01Q 21/00; H01Q 1/24; H01Q 5/01; H01Q 1/38

USPC ..... 343/718

See application file for complete search history.

(56) References Cited

U.S. PATENT DOCUMENTS

| | | | | |
|---|---|---|---|---|
| 6,980,154 | B2 | 12/2005 | Vance et al. | |
| 2004/0178958 | A1 | 9/2004 | Kadambi et al. | |
| 2007/0146218 | A1 * | 6/2007 | Turner et al. | 343/718 |
| 2008/0198082 | A1 | 8/2008 | Soler Castany et al. | |
| 2009/0033565 | A1 * | 2/2009 | Yen et al. | 343/702 |
| 2009/0284433 | A1 | 11/2009 | Tsutsumi et al. | |
| 2011/0263289 | A1 | 10/2011 | Vance | |
| 2012/0076184 | A1 | 3/2012 | Tran et al. | |
| 2013/0271325 | A1 * | 10/2013 | Andrenko | 343/700 MS |

FOREIGN PATENT DOCUMENTS

| | | | | |
|---|---|---|---|---|
| CN | 101071901 | A | 11/2007 | |
| CN | 201204252 | Y | 3/2009 | |
| JP | WO 2012/001729 | A1 * | 1/2012 | H01Q 9/38 |
| WO | WO-2008025058 | A1 | 3/2008 | |
| WO | WO-2012001729 | A1 | 1/2012 | |

OTHER PUBLICATIONS

International Search Report and Written Opinion—PCT/US2013/056546—ISA/EPO—Nov. 22, 2013.

* cited by examiner

*Primary Examiner* — Dameon E Levi
*Assistant Examiner* — Andrea Lindgren Baltzell
(74) *Attorney, Agent, or Firm* — Rupit M. Patel

(57) ABSTRACT

The various embodiments include multiple antenna system designs for use in smaller sized mobile computing devices where spatial isolation of antennas may not be feasible. The various embodiments include at least an embodiment first antenna having a first arm and a second arm. The first arm and the second arm are positioned proximate to one another in an intersecting perpendicular configuration. The at least first arm and second arm may be formed a plane that is laterally offset from a plane containing a printed circuit board operating as a ground plane. The at least first arm and second arm may also be positioned in a corner of the printed circuit board. Additional embodiments include a second monopole antenna formed in the same plane as the printed circuit board and having a feed contact positioned proximate to a feed and ground contact of the first antenna.

34 Claims, 12 Drawing Sheets

COMPACT ANTENNA SYSTEM

FIELD

The embodiments of the present disclosure relate to a compact antenna system. More particularly, the present disclosure relates to an antenna system having multiple antennas which efficiently utilize space in a mobile wireless device.

BACKGROUND

Mobile computing devices have seen explosive growth over the past few years. With growing computational power and memory capacity, personal computing devices, have become essential tools of modern life, providing telephone and text communications, navigation, photo and video functionality in a package that fits in one's pocket. As a result of providing so many different types of radio frequency communications services and displaying high-quality video, many smart phones and similar mobile computing devices are now require multiple antennas capable of transmitting and receiving (transceiving) radio signals over a variety of networks and associated bandwidths. However, the operation of multiple antennas often requires that each of the multiple antennas be isolated some distance away from one another to avoid interference or antenna coupling. In smaller sized mobile computing devices, such as the size of a wristwatch, the limited real estate prevents the effective implementation of multiple antennas without resulting in antenna coupling. Without such isolation, the mobile computing device may not operate properly as the presence of the other antennas creates performance degradation in the form of antenna coupling even though some of the antennas are not energized at the same time in the operation mode.

Some conventional devices have attempted to provide a single antenna configured to transceive radio signals over multiple networks and multiple frequency bandwidths. However, such devices with a singular antenna serving multiple networks and frequency bandwidths often provide sub-optimal performance in each of multiple networks and bandwidths. In order to allow a singular antenna to service all of the desired bandwidths and networks, additional circuitry is required to distinguish radio signals for each of the desired networks and frequency bandwidths. Such additional circuitry may increase the total cost, power consumption and volume of the mobile computing device. Moreover, a singular antenna prohibit a capability to have simultaneous operation of the radio functionality in different frequency bands.

It is desirable, therefore, to enhance the capability of simultaneously operating antennas; for instance, simultaneous among WWAN, Bluetooth, and GPS antenna. To do so, the antenna design should mitigate coupling that degrades performance. It is further desirable to increase the number of operating bands of the one or more antennas in a single wireless device in order to operate in more geographic areas. It is also desirable to reduce the size ("real estate") of printed circuit boards by requiring fewer RF components in order to support smaller and more economical wireless devices.

SUMMARY

The various embodiments include a compact antenna system which provides multiple antennas capable of transmitting and receiving ("transceiving") radio signals over various communication protocols and over various frequency bandwidths. The compact antenna system may include a first antenna configured to transceive radio signals over both a personal area network (e.g., Bluetooth®) and over a GPS network. In other embodiments, the compact antenna system may further include a second antenna configured to transceive radio signals over a WWAN network.

In embodiments, the compact antenna system may provide multiple antennas in close proximity to one another in a unique configuration which may minimize the problems of antenna coupling without the need for additional RF components while maximizing the performance of each of the multiple antennas in terms of gain and efficiency.

In an embodiment, a printed circuit board may be formed in a first plane and may act as a ground plane for the antenna system. A first antenna may be formed in a second plane which is parallel to the first plane that contains the printed circuit board and is laterally offset from the first plane. The first antenna may be a dual band antenna with a first arm and a second arm. The first arm may be configured such that the total length of the first arm and that of its ground plane is at least one half wavelength of the radio signal transceived over a first network. The second arm may be formed orthogonal to the first arm such that the second arm intersects with the first arm over a first corner of the printed circuit board. The second arm may be configured such that its total length and that of its ground plane is at least one half wavelength of the radio signal transceived over a second network. Both the first and second arms of the first antenna may be connected to the printed circuit board via the same feed contact and ground contact. The ground contact may be connected to the printed circuit board either at or very near to the first corner of the printed circuit board. The feed contact may be positioned in close proximity to the ground contact such that the feed contact is also positioned away from the edge of either the distal edge of the first arm and/or the distal edge of the second arm.

In another embodiment, the compact antenna system may include a second antenna which may be formed in the same plane as the printed circuit board. In some embodiments, the first antenna may operate in two frequency bands, namely GPS and Bluetooth. The second antenna may operate in all WWAN frequency bands including cellular band (824 MHz-960 MHz and DCS/PCS/IMT band (1700 MHz-2200 MHz). In yet another embodiment, the compact antenna system may be formed as part of a watch assembly. In such a watch embodiment, the first antenna may be housed within a personal wristwatch housing and the second antenna may be housed in the watch band of the watch assembly. In such embodiments, the second antenna may be initially formed in the same plane as the printed circuit board and housed in the watch band. The second antenna may conform to the shape of the watch band as the watch band wraps around a user's wrist.

BRIEF DESCRIPTION OF THE DRAWINGS

The accompanying drawings are presented to aid in the description of embodiments of the disclosure and are provided solely for illustration of the embodiments and not limitation thereof.

DETAILED DESCRIPTION

Figure 1:
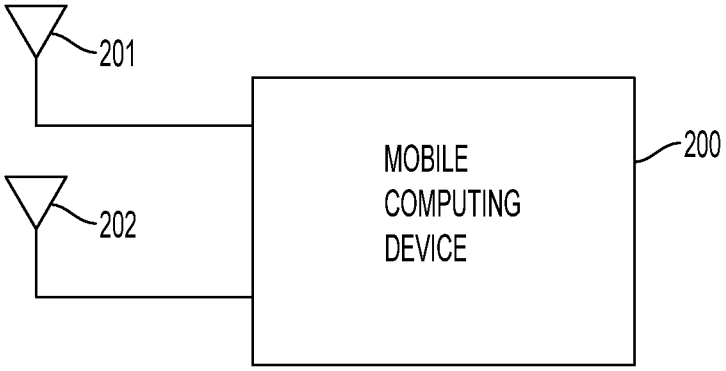
FIG. 1 is a component block diagram of a mobile computing device comprising multiple antennas.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the disclosure or the claims. Alternate embodiments may be devised without departing from the scope of the disclosure. Additionally, well-known elements of the disclosure will not be described in detail or will be omitted so as not to obscure the relevant details of the disclosure.

The words "exemplary" and/or "example" are used herein to mean "serving as an example, instance, or illustration." Any embodiment described herein as "exemplary" and/or "example" is not necessarily to be construed as preferred or advantageous over other embodiments.

The word "approximately" as used herein with respect to certain dimensions means within ten percent of the dimension, including within five percent, within two percent and within one percent of the corresponding dimension.

As used herein, the terms "computing device" and "mobile computing device" refer to any one or all of cellular telephones, smart phones, personal data assistants (PDA's), palm-top computers, tablet computers, notebook computers, personal computers, wireless electronic mail receivers, multimedia Internet enabled cellular telephones, and similar electronic devices which include multiple programmable processors, and memory.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Currently, processors have become very smaller but more powerful. Many have attempted to create a smaller sized mobile phone in a watch casing or a similar small footprint. However, these attempts have been generally unsuccessful due to limitations on antenna sizes allowed by such packages. For good radio frequency reception, the length of the antenna plus the antenna ground plane should be at least one half wavelength of the RF signals being transmitted.

Moreover, in order to provide these mobile computing devices with increased wireless connectivity, it is desirable to provide such mobile computing devices with multiple types of antennas capable of transceiving data signals over a variety of wireless protocols and frequency bandwidths. For example, an antenna for Global Positioning System (GPS) reception is increasingly required for location-based services. Another type of antenna that can be required is a short range radio antenna for a personal access network (PAN) (e.g., BLUETOOTH® (BT), ANT, ZIGBEE®, etc.). In the exemplary device, a BT antenna is specified. A third example of an antenna that may be required is Wireless Wide Area Network (WWAN) (e.g., CDMA, TDMA, 3G, 4G, LTE, UTMS, etc.).

In order to provide mobile computing devices with the ability to communication over all of these wireless protocols and networks, some conventional mobile computing devices include a single antenna configured to transceive radio signals over a variety of frequency bandwidths. Other conventional mobile computing devices include multiple antennas where each of the multiple antennas is configured to transceiver radio signals over a different frequency bandwidth.

However, such conventional mobile computing devices that include a singular antenna serving multiple protocols and frequency bandwidths often provide sub-optimal performance in each of the various frequency bandwidths. Moreover, the singular antenna prohibit the ability to have simultaneous operation in different frequency bands. In addition, in order to allow a singular antenna to service all of the desired bandwidths and networks, additional circuitry which increases cost, power consumption and total volume is required. Example of such additional circuitry may include additional radio frequency (RF) components such as RF switches, triplexers, extractor, and filters. The addition of these components increases the overall cost and size of the transceiver stage. Furthermore, each of these RF components introduce RF losses for the system, reducing the effective range of the antenna and/or the power required to run the radio, and thus increased drain on the battery.

In conventional mobile computing devices where multiple antennas are implemented the mobile computing devices must be configured of sufficient size and volume so as to provide the necessary space and volume to isolate each of the multiple antennas from one another to prevent interference or antenna coupling. Such a requirement is at odds with the desire of many mobile computing devices to provide smaller and smaller devices which increases their portability and convenience. In smaller sized mobile computing devices, such as the size of a wristwatch, the limited real estate prevents the ability to effectively isolate each of the multiple antennas from one another without resulting in increased coupling between the multiple antennas. Even if a conventional device were to schedule the operation of each of the multiple antennas so that when one antenna is transceiving, the other antennas are inactive, antenna coupling may still occur. In antenna coupling, the presence of the other antenna structures may cause some of the energy radiating from the operating antenna to be absorbed by the inactive antenna structures.

The various embodiments of the instant invention may provide a mobile computing device with multiple antennas in close proximity to one another in a unique configuration which may minimize the problems of antenna coupling without additional RF components while maximizing the performance of each of the multiple antennas in terms of gain and efficiency. The antenna configurations of the various embodiments provide a compact set of antennas suitable for incorporation within the footprint of a wrist watch device that exhibit efficient broad spectrum antenna performance.

FIG. 1 is a component block diagram of an embodiment mobile computing device comprising multiple antennas. As shown in FIG. 1, a mobile computing device 200 may include a first antenna structure 201 and a second antenna structure 202. The first antenna structure 201 may be a dual-band Planar Inverted F Antenna (PIFA) having a first arm 203 and a second arm 204. The first arm 203 and the second arm 204 are formed orthogonal to one another. (shown in FIGS. 2-7 and 9-11). The first arm 203 may be configured to transceive radio signals over a personal access network (PAN) using a wireless protocol such as Bluetooth®, ANT, or Zigbee®. The second arm 204 may be configured to transceive radio signals over a GPS network. The second antenna structure 202 may be a monopole antenna configured to transceive radio signals over a wide area network Wireless Wide Area Network (WWAN) (e.g., CDMA, TDMA, 3G, 4G, LTE, UTMS, etc.).

Figure 2:
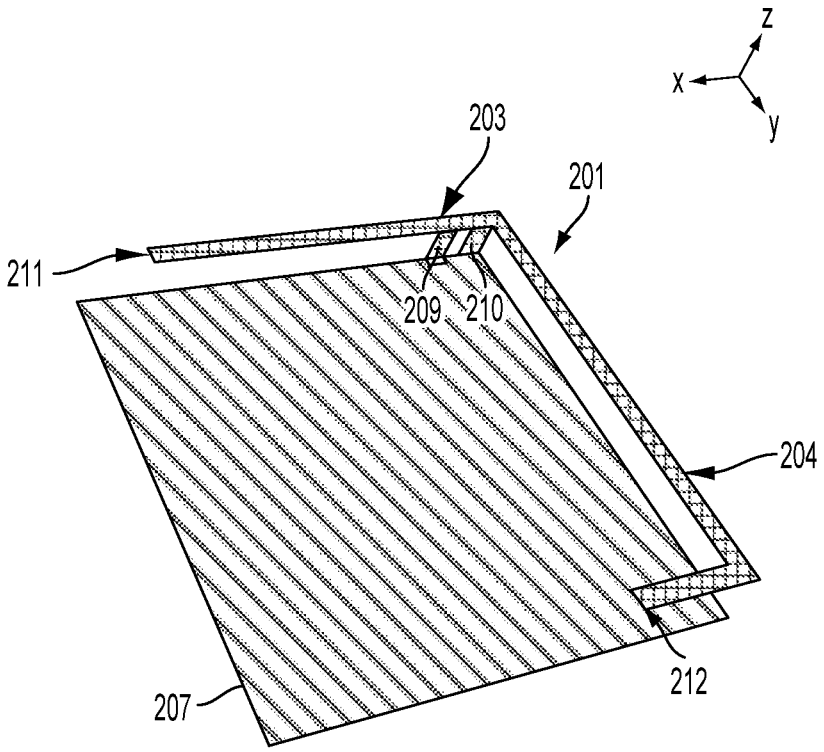
FIG. 2 is a perspective view of an embodiment compact antenna system.

FIG. 2 is a perspective view of the first antenna 201 in an embodiment compact antenna system which may include multiple arms 203 and 204 positioned in close proximity to one another. For sake of reference among the figures, a 3-dimensional reference may be shown with the x-y-z axis labeled or a 2-dimensional reference may be shown with the x-y, x-z, or y-z plane labeled. As shown in FIG. 2 the compact antenna system may include a printed circuit board 207 formed in a first x-y plane. The printed circuit board 207 may act as a ground plane for the various antennas forming the compact antenna system. As shown in FIG. 2, the printed circuit board 207 may generally be formed as a quadrilateral. In a preferred embodiment, the printed circuit board 207 may be a square in order to more efficiently fit within a watch housing. This embodiment enables a watch phone, such as described below with reference to FIG. 11.

The compact antenna system may also include a first antenna structure 201. The first antenna 201 may include a first arm 203 and second arm 204. As shown more clearly in FIG. 4, the first antenna 201 may be formed in a second x-y plane that is laterally offset in a perpendicular z-axis direction from the printed circuit board 207 formed in the first x-y plane.

The first arm 203 and second arm 204 may be formed to perpendicularly intersect one another in the second x-y plane over a first corner of the printed circuit board 207 formed in the first x-y plane. A ground contact 210 may be positioned beneath the intersection point to connect the first antenna structure 201 to the first corner of the printed circuit board 207. A feed contact 209 may also connect the first antenna 201 to the printed circuit board 207 and may be positioned in close proximity to the ground contact 210. By positioning the feed contact 209 in close proximity to the ground contact 210 and in close proximity to the first corner of the printed circuit board 207, the feed contact 209 may be positioned distally away from the edge 211 of the first arm 203 as well as distally away from the edge 212 of the second arm 204. Such a configuration allows the first arm 203 and second arm 204 to operate independently in two separate frequency bands despite being formed as a single, continuous conducting surface. As energy is injected into the first antenna 201 at the feed contact 209 current flows along both the first arm 203 and the second arm 204. While current at the feed contact 209 is at its highest value, the generated electrical field is minimal at the feed contact 209. Thus, in the area where the first arm 203 and the second arm 204 are in close proximity to one another (i.e., at the first corner of the printed circuit board 207), the electrical field generated along each arm 203, 204 is not sufficient to couple the other arm. As current propagates along each arm 203, 204, the magnitude of current decreases while the generated electrical field increases such that the magnitude of the electrical filed is greatest at the respective edges 211 and 212 of the first arm 203 and second arm 204. The electrical field waves are directed along each arm 203, 204 in a direction perpendicular to one another. Since the electrical field waves along each of the arms 203 and 204 are directed perpendicular to one another and the edges 211 and 212 (where the electrical fields are greatest) are separated by a sufficient distance, each arm 203 and 204 may transmit and receive electromagnetic radiation independent of one another with minimal levels of antenna coupling. In this manner, each of the arms 203, 204 may be independently tuned to a desired operating frequency band. Put another way, the effective length of the first arm 203 may be configured to tune to the desired operating frequency without concern for the coupling impact of the second arm 204, and vice versa.

Figure 3:
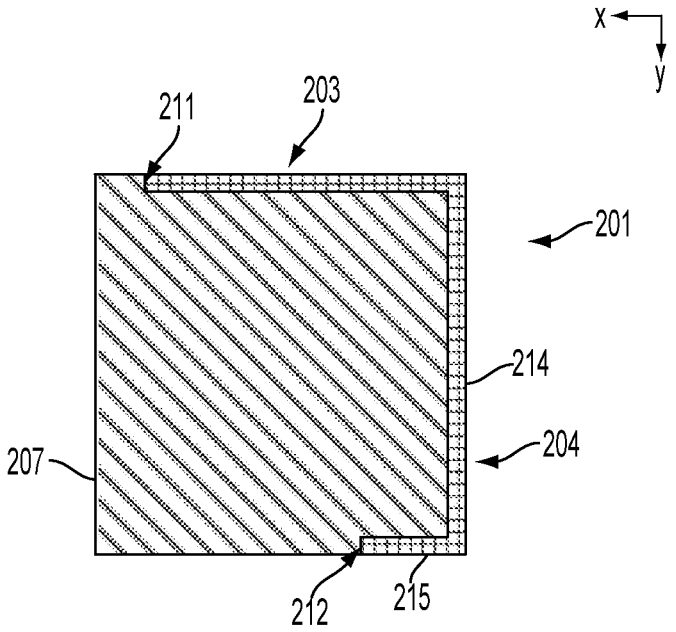
FIG. 3 is a top view of an embodiment compact antenna system.

FIG. 3 is a top view of the embodiment compact antenna system shown in FIG. 2 as viewed from above in the z-axis. As shown in FIG. 3, the printed circuit board 207 may be a square surface. In other embodiments, the printed circuit board may be more rectangular in shape. The spatial restrictions of the specific application in which the compact antenna system is implemented may dictate the exact dimensions and shape of the printed circuit board 207. In order to insure that the compact antenna system also fits within the confines of any housing containing the printed circuit board 207, the compact antenna system may be formed such that the perimeter of the compact antenna system does not exceed the perimeter dimensions of the printed circuit board 207.

In some embodiments, the size and shape of the printed circuit board 207 may be such that the dimensions of the printed circuit board 207 are less than the length required for the second arm 204 to properly transceive radio signals at the required frequency of the second network. In order to configure the length of the second arm 204 to provide the necessary half wavelength dimension, the second arm 204 may be formed from a first segment 214 and a second segment 215. The first segment 214 may be formed to be the maximum dimension allowed while still being contained within the perimeter of the printed circuit board 207 positioned below the first segment 214. The second segment 215 may be configured in a direction perpendicular to the first segment 214 and intersect the first segment 214 over a second corner of the printed circuit board 207. In such an embodiment, the cumulative length of the first segment 214 and the second segment 215 may be such that its total length and that of its ground plane is at least one half wavelength of the radio signal transceived over the second network (i.e. GPS network). Although the second segment 215 is parallel to the first arm 203, the second segment 215 is located distal from the first arm 203 and thus, sufficiently isolated from the first arm to prevent interference and/or coupling between the first arm 203 operating in a first frequency band and the second arm 204 operating in a second frequency band. More to the point, the edge of the first arm 211 where the electrical field waves propagating from the first arm 203 is separated from the edge of the second arm 212 from which the electrical field waves propagate from the second arm 204. Consequently, the waves propagating from each the two antenna edges 211, 212 do not significantly interfere with one another.

The configuration of the first antenna structure 201 illustrated in FIG. 3 allows the compact antenna system to provide both the first arm 203 and the second arm 204 while sharing the same footprint as the printed circuit board 207. Thus, the compact antenna system may occupy the same footprint as the printed circuit board 207 formed beneath the compact antenna system. In applications that allow for the second arm 204 to extend beyond the perimeter of the printed circuit board 207, the second arm 204 may be formed from a single segment that is configured such that its total length and that of its ground plane is at least one half wavelength of the radio signal transceived over the second network (i.e. GPS network).

Figure 4:
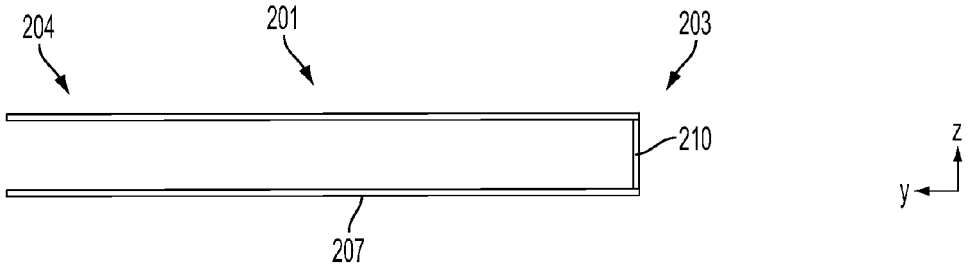
FIG. 4 is a first planar view of an embodiment compact antenna system.

FIG. 4 is a side view of the first antenna structure 201 shown in FIGS. 2 and 3 as viewed from the right side of FIGS. 2 and 3 along the x-axis. As shown in FIG. 4, the first antenna structure 201 which may include a first arm 203 and second arm 204 may be formed in the second x-y plane and is laterally offset in the perpendicular z-axis direction from the printed circuit board 207 formed in the first x-y plane. The first antenna structure 201 is offset from the printed circuit board 207 by the feed contact 209 (not shown if FIG. 4) and ground contact 210 connecting the first antenna structure 201 to the printed circuit board 207.

Figure 5:
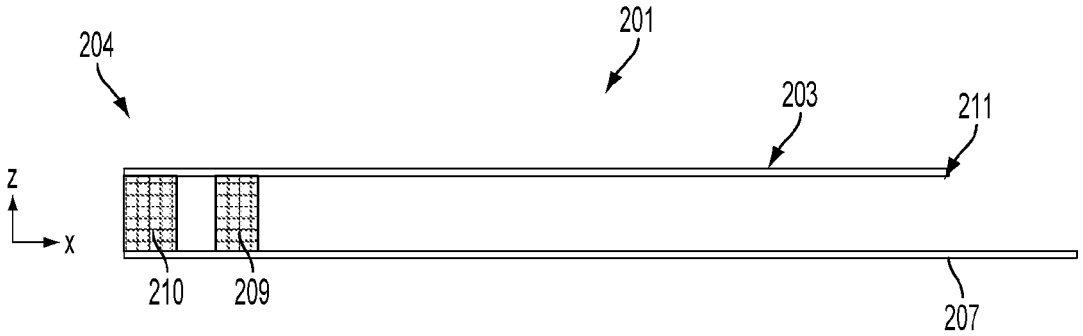
FIG. 5 is a second planar view of an embodiment compact antenna system.

FIG. 5 is a side view of the first antenna structure 201 shown in FIGS. 2 and 3 as viewed from the top side of FIGS. 2 and 3 along the y-axis. As shown in FIG. 5, the first antenna structure 201 which may include a first arm 203 and second arm 204 may be formed in the second x-y plane and is laterally offset in the perpendicular z-axis direction from the printed circuit board 207 formed in the first x-y plane. The first antenna structure 201 is offset from the printed circuit board 207 by the ground contact 210 as well as the feed contact 209 connecting the first antenna structure 201 to the printed circuit board 207. Also shown in FIG. 5, the edge of the first arm 211 is offset from the edge of the printed circuit board 207 as the first arm 203 may be configured to be of a shorter length than the width dimension of the printed circuit board 207 depending on the desired operating frequency for which the first arm 203 is tuned.

Figure 6:
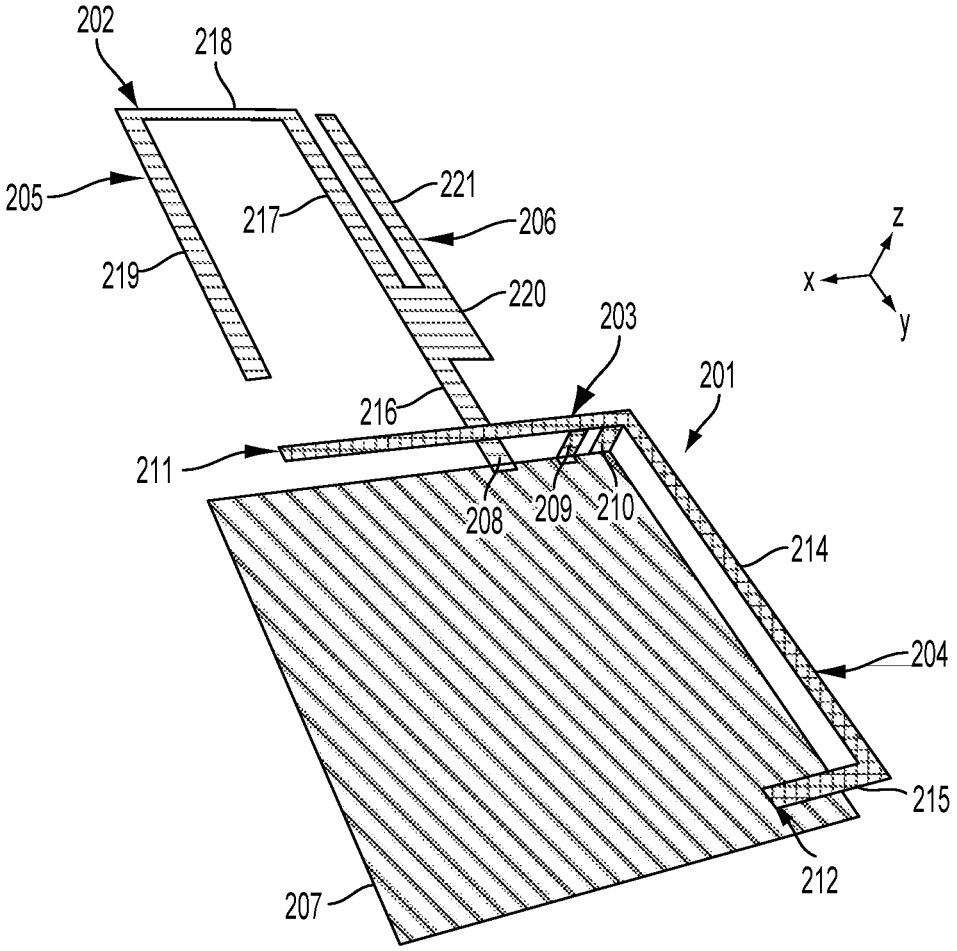
FIG. 6 is a perspective view of a second embodiment compact antenna system.

FIG. 6 is a perspective view of another embodiment compact antenna system which may include multiple antennas positioned in close proximity to one another without interfering or significantly coupling with each other. For sake of reference among the figures, a 3-dimensional reference is shown with the x-y-z axis labeled. As shown in FIG. 6 the compact antenna system may contain all of the elements 201-215 illustrated in FIGS. 2-5 and described in more detail above. In addition, the embodiment shown in FIG. 6 may include a second antenna 202. The second antenna 202 may be formed in the same first x-y plane as the printed circuit board 207. The second antenna 202 may be formed as a monopole antenna. Since the second antenna 202 and the first antenna 201 are different types of antennas (i.e., monopole v. PIFA), the coupling between the second antenna 202 and the first antenna 201 may be minimized. Also, the second antenna 202 may be formed in a first x-y plane that is perpendicularly offset from the second x-y plane in which the first antenna 201 including first arm 203 and second arm 204 may be formed. This configuration may further allow the second antenna 202 to transceive radio signals simultaneously with both the first arm 203 and second arm 204 of the first antenna 201 without significant interference and/or coupling among the first antenna's first arm 203 and second arm 204, and the second antenna 202.

As discussed above, the second antenna 202 may be formed as a monopole antenna. The second antenna 202 may further be configured to contain a third arm 205 and a fourth arm 206. The third arm 205 may be configured to transceive radio signals over a first lower frequency bandwidth of the WWAN. The fourth arm 206 may be configured to transceive radio signals over a second higher frequency bandwidth of the WWAN.

The second antenna 202 may be formed co-planar with the printed circuit board 207 in the first x-y plane. The second antenna 202 may also extend beyond the perimeter of the printed circuit board 207. In embodiments where the compact antenna system of FIG. 6 may be implemented in a watch, the printed circuit board 207 and first antenna structure 201 may be contained in a watch housing of a watch phone, while the second antenna 202 may be connected to the printed circuit board 207, but contained within a watch band of the watch phone, as described below with reference to FIG. 11.

The second antenna 202 may include a common segment 216 from which the third arm 205 and the fourth arm 206 extend. The common segment 216 may connect the second antenna 202 to the printed circuit board 207 at a second antenna feed contact 208. The second antenna contact feed 208 may be positioned proximate to the feed contact 209 as well as to the ground contact 210 which is positioned at or near to the first corner of the printed circuit board 207. By placing the second antenna contact feed 208 proximate to the feed contact 209 as well as to the ground contact 210, coupling between the first antenna structure 201 (containing the first arm 203 and second arm 204) and the second antenna structure 202 may be prevented. As discussed above, electrical energy may be injected into the antenna structure at a feed contact. At these locations, the current density is at a maximum value, while the electrical field is at a minimum. Conversely, at the respective edges of each antenna structure, the current density is at a minimal value, while the electrical field is at a maximum density. Antenna coupling occurs where the electrical fields generated is at its maximum density. By positioning the feeds 208 and 209 in close proximity to one another, the electrical field generated in the areas in which the first antenna 201 and the second antenna 202 are in close proximity to one another may be minimized, thus the effective coupling between the two antennas may be reduced. Also, by forming the first antenna 201 and the second antenna 202 is separate x-y planes, the coupling between antennas may be further reduced.

The common segment 216 may extend distally away (along the y-axis) from the printed circuit board 207. Both the third arm 205 and the fourth arm 206 may be connected to the common segment 216. The third arm 205 may be formed from a third segment 217, a fourth segment 218 and a fifth segment 219. The third segment 217 may extend distally away from the common route 216 (and distally away from the printed circuit board 207) along the y-axis. The fourth segment 218 may intersect the third segment 217 and extend in a perpendicular direction away from the third segment 217 (along the x-axis). The fifth segment 219 may intersect the fourth segment 218 and extend in a perpendicular direction away from the second segment 218 (along the y-axis) but toward the printed circuit board 207 to form a substantial "hook" configuration. The third segment 217, fourth segment 218 and fifth segment 219 may be configured such that their cumulative length and that of common segment 216 and ground plane (i.e., printed circuit board 207) is at least one half wavelength of the radio signal transceived over a first lower frequency band of the third network The fourth arm 206 may be formed from a sixth segment 220 and a seventh segment 221. The sixth segment 220 may extend in a perpendicular direction away from the common segment 216 (along the x-axis). The seventh segment 221 may intersect the sixth segment 220 and extend in a perpendicular direction away from the sixth segment 220 (along the y-axis) and also in a direction away from the printed circuit board 207. The sixth segment 220 and seventh segment 221 may be configured such that their cumulative length and that of common segment 216 and ground plane (i.e., printed circuit board 207) is at least one half wavelength of the radio signal transceived over a second higher frequency band of the third network.

Figure 7:
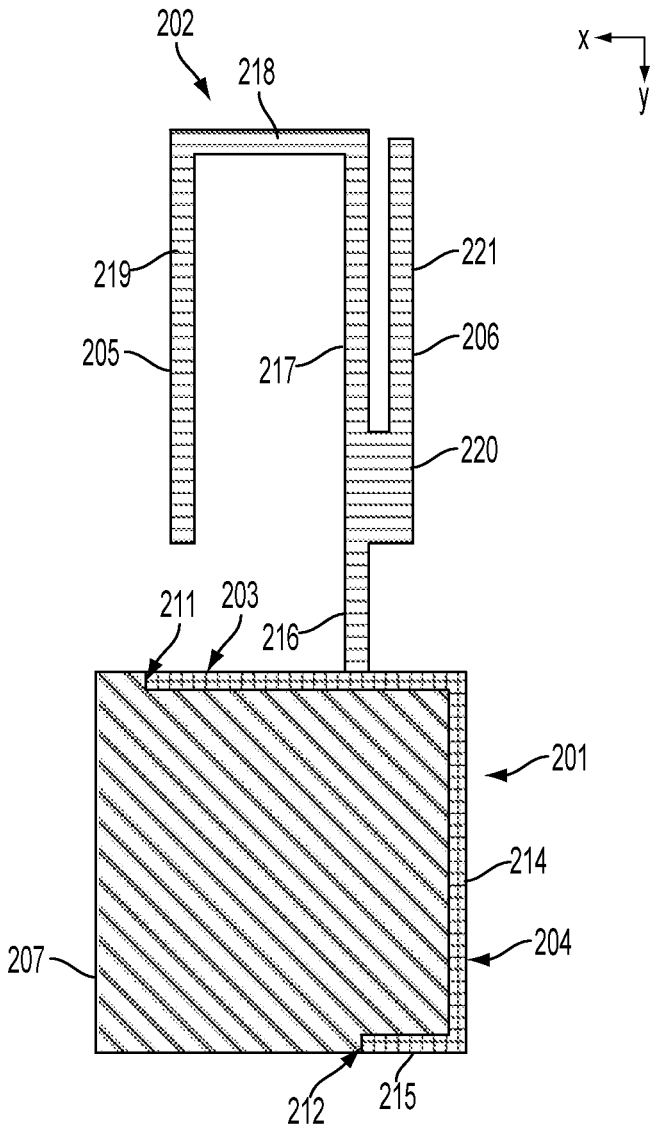
FIG. 7 is a top view of the second embodiment compact antenna system.

FIG. 7 is a top view of the embodiment compact antenna system shown in FIG. 6 as viewed from above in the z-axis. As shown in FIG. 7, the printed circuit board 207 is a square surface. In other embodiments, the printed circuit board may be more rectangular in shape. The spatial restrictions of the specific application in which the compact antenna system is implemented may dictate the exact dimensions and shape of the printed circuit board 207. In order to insure that the compact antenna system also fits within the confines of any housing containing the printed circuit board 207, the compact antenna system may be formed such that the perimeter of the first antenna structure 201 does not exceed the perimeter dimensions of the printed circuit board 207. Further, the second antenna 202 may extend beyond the perimeter of the printed circuit board 207.

Figure 8:
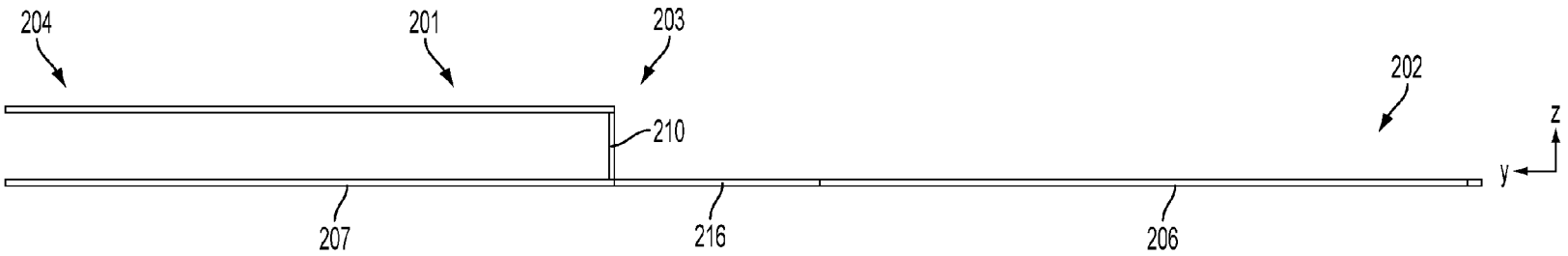
FIG. 8 is a planar view of the second embodiment compact antenna system.

FIG. 8 is a side view of the embodiment compact antenna system shown in FIGS. 6 and 7 as viewed from the right side of FIGS. 6 and 7 along the x-axis. As shown in FIG. 8, the first antenna structure 201, which may include a first arm 203 and second arm 204, may be formed in the second x-y plane and may be laterally offset in the perpendicular z-axis direction from the printed circuit board 207 formed in the first x-y plane. The first antenna structure 201 may be offset from the printed circuit board 207 by the ground contact 210 (and the feed contact 209, not shown) connecting the first antenna structure 201 to the printed circuit board 207. In addition, the second antenna 202 may be formed in the same first x-y plane as the printed circuit board 207. The second antenna 202 may extend beyond the edge of the printed circuit board 207.

Figure 9:
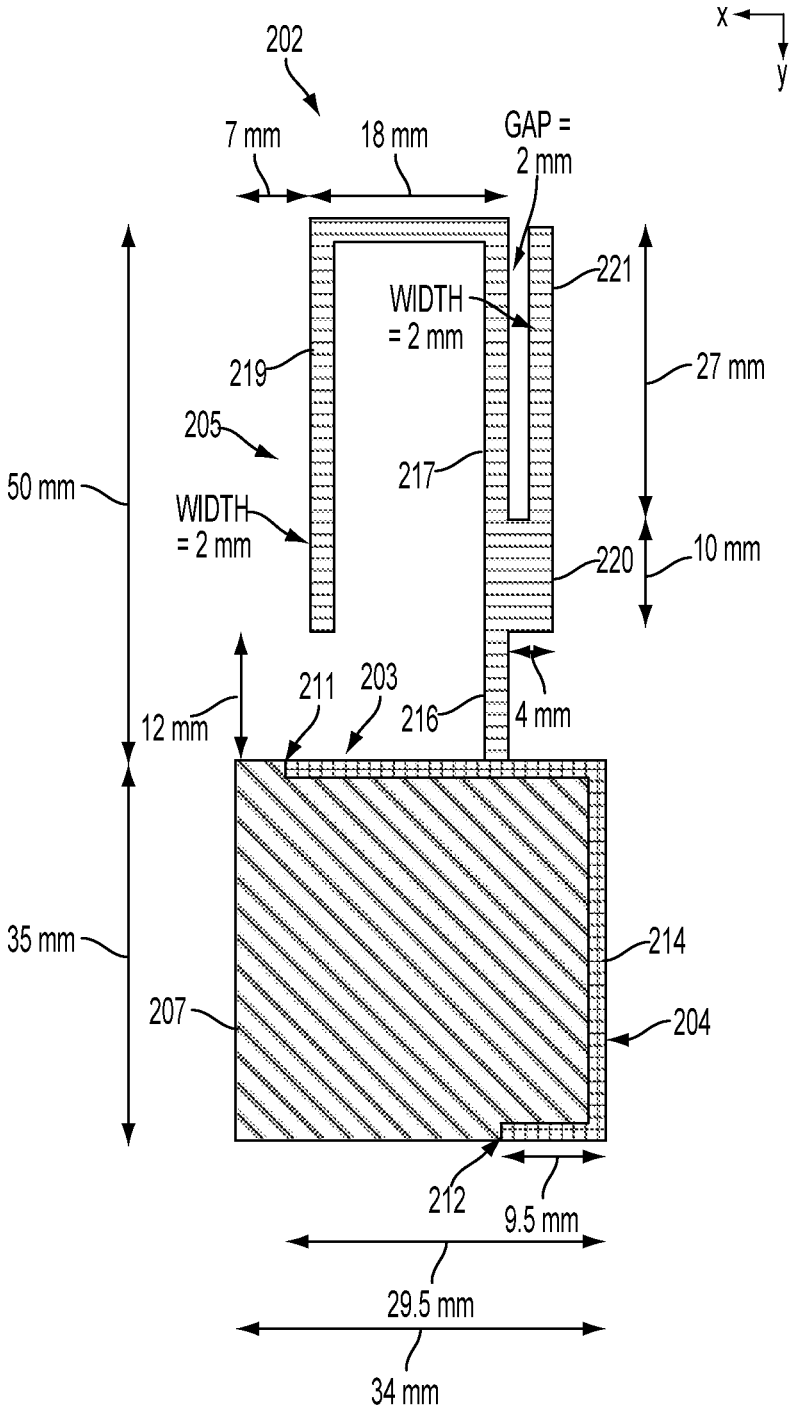
FIG. 9 is a perspective view of an embodiment compact antenna system having specific dimensions.

FIG. 9 is a top view of a preferred embodiment compact antenna system with example dimensions for implementation in a watch sized mobile computing device. The description and configuration of each of the elements shown in FIG. 9 is the same as those described in FIG. 7. However, in the embodiment shown in FIG. 9, specific element dimensions are listed. One of skill in the art would understand that each of the element dimensions is proportional to the frequency bandwidth at which each antenna is desired to transceive radio signals, as well as to the size of the printed circuit board 207 that functions as a ground plane for the various disclosed antennas. As shown in FIG. 9, the printed circuit board 207 may be formed as a square surface. In other embodiments, the printed circuit board may be more rectangular in shape. The spatial restrictions of the specific application in which the compact antenna system is implemented may dictate the exact dimensions and shape of the printed circuit board 207. In order to insure that the compact antenna system also fits within the confines of any housing containing the printed circuit board 207, the compact antenna system may be formed such that the perimeter of the compact antenna system does not exceed the perimeter dimensions of the printed circuit board 207. Further, the second antenna 202 may extend beyond the perimeter of the printed circuit board 207.

In the embodiment shown in FIG. 9, the printed circuit board 207 may measure approximately 35 mm by approximately 34 mm. Such dimensions are well within the size constraints of a typical watch housing such that a printed circuit board 207 having those dimensions (as well as the first arm 203 and second arm 204) may be housed within the typically sized watch housing. In other embodiments where a mobile computing devices 200 allows for a larger printed circuit board 207 or requires a smaller printed circuit board 207, the dimensions of the corresponding elements may be proportionally adjusted. In the embodiment shown in FIG. 9, the first arm 203 may measure approximately 29.5 mm by approximately 1.5 mm. The second arm 204 may measure 44.5 mm in cumulative length, with the first segment 214 measuring approximately 35 mm by approximately 1.5 mm and the second segment measuring approximately 9.5 mm by approximately 1.5 mm. As discussed in more detail above, the second antenna 202 may comprise a common segment 216, a third arm 205 and a fourth arm 206. The common segment 216 may measure approximately 2 mm by approximately 12 mm. The third arm 205 may comprise a third segment 217, a fourth segment 218 and a fifth segment 219. The third segment 217 may measure approximately 2 mm by approximately 37 mm. The fourth segment 218 may measure approximately 18 mm by approximately 2 mm. The fifth segment 219 may measure approximately 2 mm by approximately 38 mm. The fifth segment 219 may be separated from the printed circuit board 207 by approximately 12 mm. The fourth arm 206 may comprise a sixth segment 220 and a seventh segment 221. The sixth segment may measure approximately 4 mm by approximately 10 mm. The seventh segment 221 may measure approximately 2 mm by approximately 27 mm. The seventh segment 221 may be separated from the third segment 217 by approximately 2 mm. The total dimensions of the compact antenna system may measure approximately 85 mm by approximately 34 mm.

Figure 10:
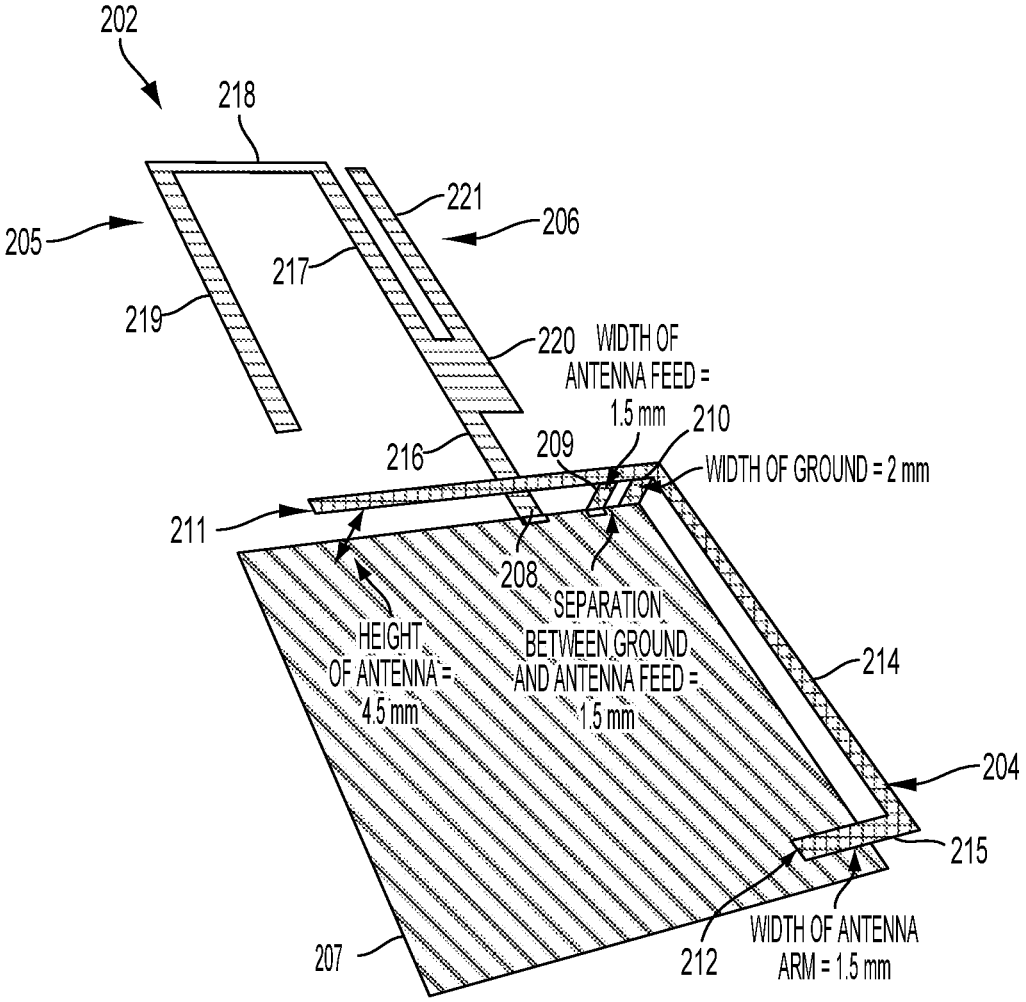
FIG. 10 is a first perspective view of an embodiment compact antenna system having specific dimensions.

FIG. 10 is a perspective view of the preferred embodiment shown in FIG. 9. As shown in FIG. 10, the ground contact 210 may be positioned at the first corner of the printed circuit board 207. The ground contact 210 may measure approximately 2 mm in width and extend approximately 4.5 mm to offset the first antenna 201 having the first arm 203 and second arm 204 laterally away from the printed circuit board 207 by approximately 4.5 mm. The feed contact 209 may be positioned approximately 1.5 mm away from the ground contact 210 such that there may be a gap of about 1.5 mm between the feed contact 209 and ground contact 210. The feed contact 209 may measure approximately 1.5 mm in width and extends approximately 4.5 mm to offset both the first arm 203 and second arm 204 laterally away from the printed circuit board 207 by approximately 4.5 mm. The second antenna feed contact 208 may be positioned in close proximity to the feed contact 209 and within approximately 10 mm of the first corner of the printed circuit board.

Figure 11:
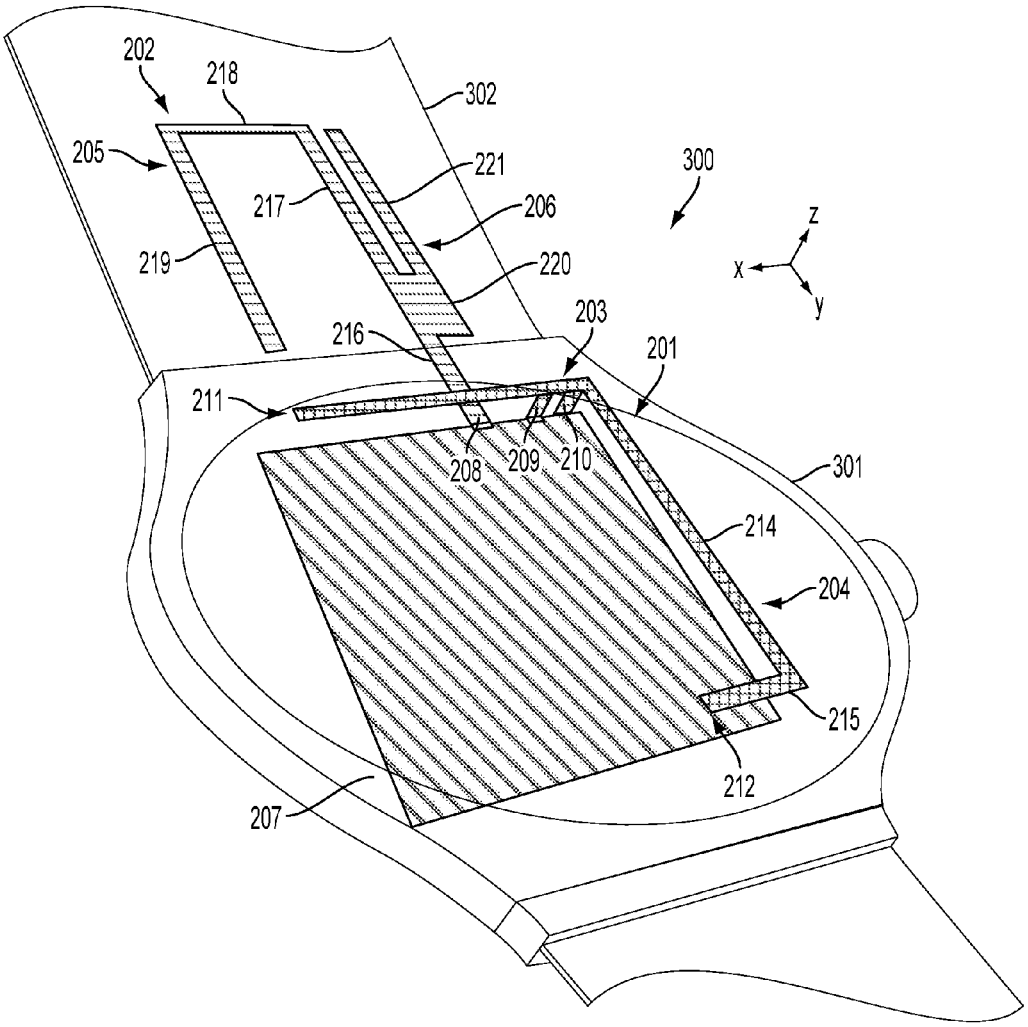
FIG. 11 is a perspective view of a third embodiment compact antenna system implemented in a watch mobile computing device.

FIG. 11 is a perspective view of a watch phone embodiment wherein the compact antenna system is shown within a watch housing and watch band. A watch phone may include processor and transceiver elements substantially similar to those in a conventional cellular telephone, but with a packaging and form factor configured to fit within a watch housing. In such a watch phone implementation the elements of the compact antenna system shown in FIG. 11 may be substantially the same as those previously disclosed above with respect to FIGS. 2-10. Referring to FIG. 11, the compact antenna system may be implemented within a watch phone 300 which may include a watch housing 301 and watch band 302. As shown in FIG. 11, the printed circuit board 207, first antenna 201 having the first arm 203 and second arm 204 as well as feed contact 209, ground contact 210 and second antenna feed contact 208 may be contained within the watch housing 301. The second antenna 202 may be connected to the printed circuit board 207 via the second antenna feed contact 208 but may be contained within the watch band 302. In such embodiments, the second antenna 202 may be initially formed in the same plane as the printed circuit board 207 and housed in the watch band 302. For example, the second antenna 202 may be injection molded into the watch band 302. Accordingly, the second antenna 202 may conform to the shape of the watch band 302. When worn by a user, the watch band 302 may wrap around a user's wrist. The second antenna 202 may flexibly conform to the watch band 302 as it wraps around the user's wrist. Consequently, while the second antenna 202 may be initially formed in the same plane as the printed circuit board 207, the second antenna 202 may no longer be in the same plane as the printed circuit board 207 when utilized in such embodiments.

When designing antenna it is important to consider an antenna's return loss. Return loss (S11) is a measure of how much energy is reflected by an antenna back toward the device in which the antenna is implemented. When a particular antenna design is implemented in a device and energy is provided to the antenna, one may measure the return loss to determine how efficiently the antenna design is radiating a signal away from the device containing the antenna (and toward a receiving device). The measure of return loss is viewed along a dB scale.

A poorly designed antenna will result in some of the energy provided to the antenna being reflected back to the device containing the poorly designed antenna. As an example, if the antenna is transmitting a radio signal at a particular frequency, but the antenna and ground plane is not configured in length to be approximately a half wavelength of the radio signal at a particular frequency, then much of the energy used to transmit the radio signal will be reflected back to the device and the transmitted signal will experience a significant energy loss. Consequently, the range or power of the received signal will be greatly diminished.

While it may be easy to design an antenna to transmit signals of a single frequency, it is impractical to transmit signals of only a singular frequency. In practice, devices transmit signals across a bandwidth and so the same antenna must be designed to transmit signals of varying frequencies and as a result of varying wavelengths. Antennas operating across wider bandwidths or multiple bandwidths become increasingly difficult to design as the antenna must be designed to accommodate a wider variation of signal wavelengths.

In order to design an antenna that may operate across a wide band the antenna, antenna designers implement antennas of varying shapes, sizes, and configurations. For example, the second antenna 202 shown in FIGS. 2-11 may include multiple segments (i.e., segments 217, 218, 219) of varying sizes to form the hook shape (or U-shape) of the third arm 205. Such a shape and sized antenna may be found to operate well across the lower first frequency band (~800 MHz-960 MHz) of a WWAN. An ideally designed antenna will pass all of the energy provided to the antenna to the receiving device but this is not possible for wide band antenna. In practice, when viewing the amount of return loss for wide band small antenna, one typically looks to see a measure of return loss to be less than −5 db. If the amount of return loss is less than −5 db across the desired frequency bandwidth, the antenna is said to be well designed for that operating frequency bandwidth.

Figure 12:
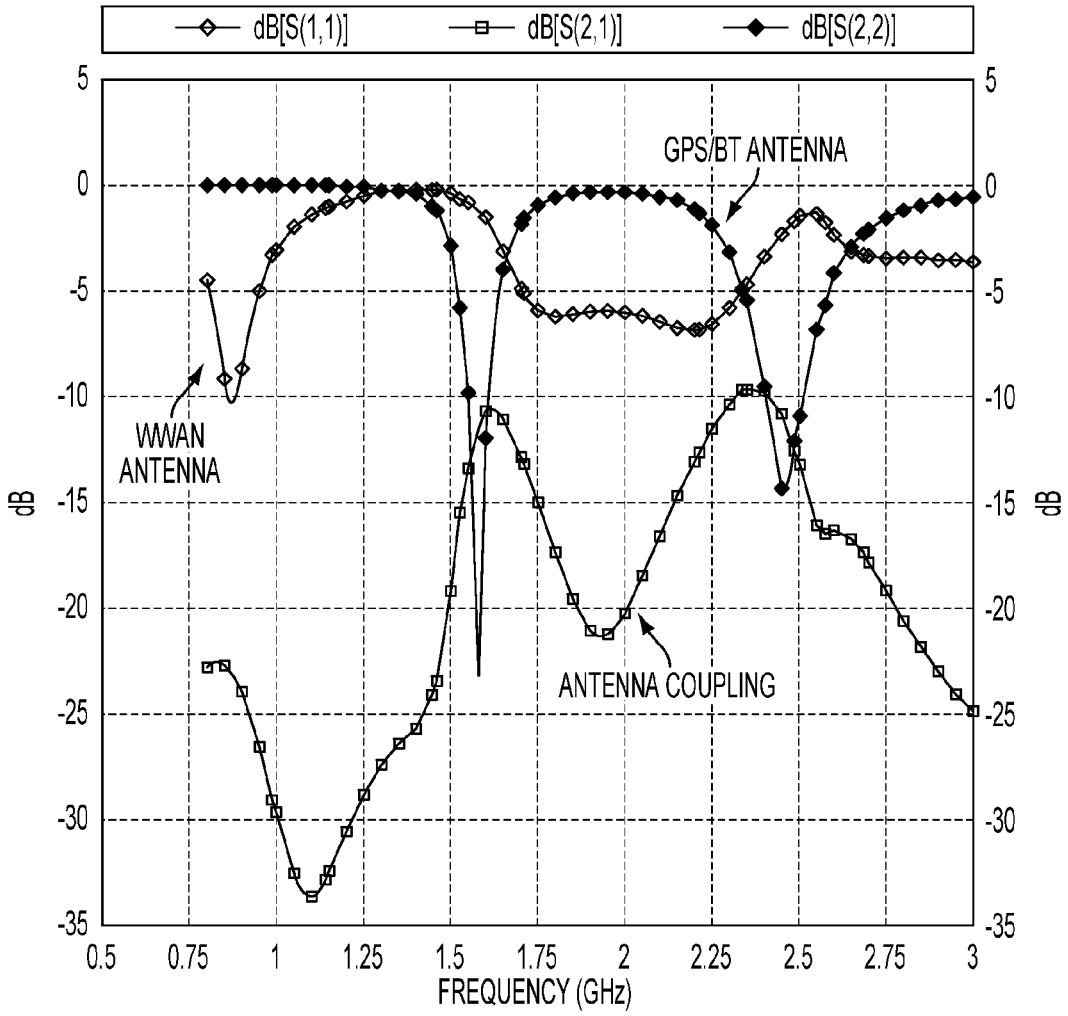
FIG. 12 is a graph of the simulation results of an embodiment compact antenna system.

FIG. 12 is a graph of the simulation results of the various embodiment compact antenna systems shown in FIGS. 6-11. In a typical personal access network such as Bluetooth®, the PAN antenna arm (first arm 203) may operate in a frequency band of 2400 MHz to 2500 MHz. In a typical GPS network, the GPS antenna arm (second arm 204) may operate in a frequency band of 1565 MHz to 1610 MHz. In a typical WWAN network, the WWAN antenna (second antenna 202) operates in two frequency bands. The first lower frequency band may be 824 MHz to 960 MHz. The second higher frequency band may be 1710 MHz to 2170 MHz. Turning to FIG. 12, one may view the simulation results for the first antenna structure 201 which contains both the first arm 203 and second arm 204. Since the first arm 203 is operating over a PAN that may require an operating frequency bandwidth of 2400 MHz to 2500 MHz, one hopes to see less than −5 dB of return loss over the operating frequency bandwidth of 2400 MHz to 2500 MHz. FIG. 12 indicates that over the operating frequency of 2400 MHz to 2500 MHz, the measured return loss is significantly lower than −5 dB. Indeed, the measure of return loss is as low as −14 dB at 2450 MHz. Thus, first antenna structure 201 is a well designed antenna for PANs. In addition, FIG. 12 indicates that over the operating frequency of 1565-1610 MHz (the operating frequency bandwidth for a GPS network), the measured return loss is significantly lower than −5 dB. Indeed, the measure of return loss is as low as −23 dB in the operating frequency band. Thus, first antenna structure 201 is also a well designed antenna for GPS networks.

Moreover, looking at the simulation results for the second antenna structure 202, the measure of return loss is well below the −5 dB threshold across the lower frequency bandwidth of 824 MHz-960 MHz. Indeed, the measure of return loss is as low as −10 dB within the desired lower frequency bandwidth for a WWAN. In addition, FIG. 12 shows that the measure of return loss is well below the −5 dB threshold across the higher frequency bandwidth of 1710 MHz to 2200 MHZ. Thus, the second antenna structure 202 may be considered a well designed antenna for WWAN operation.

In devices containing multiple antennas, it is further important to consider antenna coupling. While an antenna may be ideally designed to operate within its desired frequency bandwidth, it may be possible that when a collection of ideally designed antennas are located in close proximity to one another, the multiple antennas may couple one another. When an antenna is coupled with another antenna, the energy provided to radiate a radio signal out from the device may be unintentionally absorbed by the other antennas in close proximity. Thus, when designing a multiple antenna system such as the embodiment compact antenna systems disclosed herein, it is also important to consider antenna coupling.

To determine the amount of antenna coupling that may exist in a system one may measure the amount of energy imparted on the other antennas in the multiple antenna system when a particular antenna is transmitting. As an example, when the first antenna structure 201 (either the first arm 203 or second arm 204) is transmitting a signal over its desired frequency bandwidth, one may measure the isolation (S21) between the two antennas 201 and 202. A well designed antenna system will result in a measure of isolation (S21) between the two antennas 201 and 202 of less than −10 dB across the entire frequency bandwidths.

As shown in FIG. 12, the measure of isolation (S21) is less than −10 dB across the frequency spectrum. Accordingly, the compact antenna systems disclosed in the various embodiments may be considered to be a well designed antenna system. Each of the individual antenna designs displays decent return loss characteristics (i.e., less than −5 dB return loss across the desired frequency bands). In addition, the amount of antenna coupling is less than −10 dB across the entire frequency spectrum.

The preceding description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the following claims and the principles and novel features disclosed herein.

What is claimed is:

1. A compact antenna system configured for use in a small sized, multi-radio device, comprising:

a printed circuit board formed in a first plane;

a first antenna formed in a second plane parallel and laterally offset from the printed circuit board, the first antenna comprising:

a first arm configured in length to transmit/receive radio signals over a first network;

a second arm configured in length to transmit/receive radio signals over a second network, wherein the second arm intersects the first arm over a first corner of the printed circuit board and extends perpendicularly away from the first arm;

a feed contact for providing current to the first arm and the second arm, wherein the feed contact is positioned distally away from an edge of the first arm and from an edge of the second arm;

a ground contact for connecting the first arm and the second arm to a grounding plane, wherein the ground contact is positioned proximate to the feed contact and distally away from an edge of the first arm and an edge of the second arm, wherein the feed contact and the ground contact connect the first antenna to the printed circuit board and are positioned near the first corner of the printed circuit board.

2. The compact antenna system of claim 1, wherein the first arm is configured in length to transmit/receive radio signals over a personal area network.

3. The compact antenna system of claim 1, wherein the second arm is configured in length to transmit/receive radio signals over a Global Positioning System (GPS) network.

4. The compact antenna system of claim 1, wherein the second arm comprises:

a first segment; and a second segment, wherein the first segment intersects the first arm near the first corner of the printed circuit board and extends perpendicularly away from the first arm, wherein the second segment intersects the first segment over a second corner of the printed circuit board and extends perpendicularly away from the first segment, and wherein the first segment and the second segment are configured with a cumulative length to transmit/receive radio signals over the second network.

5. The compact antenna system of claim 1 wherein both the feed contact and the ground contact are configured to extend perpendicularly away from the first plane of the printed circuit board and laterally offset the first antenna from the printed circuit board.

6. The compact antenna system of claim 5, further comprising:

a second antenna comprising a conductive layer extending beyond an edge of and coplanar with the printed circuit board, the second antenna configured to transmit/receive radio signals over a third network; and a second antenna feed contact connecting the second antenna to the printed circuit board.

7. The compact antenna system of claim 6, wherein the second antenna comprises:

a common segment coupled to the printed circuit board via the second antenna feed contact;

a third arm; and a fourth arm, wherein the third and fourth arms extend from the common segment, with the third arm configured to transmit/receive radio signals of a first frequency band of the third network and the fourth arm of the second antenna configured to transmit/receive radio signals of a second frequency band of the third network.

8. The compact antenna system of claim 7, wherein the second antenna is configured to transmit/receive radio signals over a WWAN network.

9. The compact antenna system of claim 7, wherein the third arm comprises:

a third segment extending from the common segment away from the printed circuit board;

a fourth segment extending perpendicularly away from the third segment; and a fifth segment extending perpendicularly away from the fourth segment and toward the printed circuit board.

10. The compact antenna system of claim 9, wherein the third, fourth and fifth segments are configured with a cumulative length to transmit/receive radio signals oscillating in the first frequency band of the third network.

11. The compact antenna system of claim 7, wherein the fourth arm comprises:

a sixth segment extending perpendicularly away from the common segment; and a seventh segment extending perpendicularly from the sixth segment and away from the printed circuit board.

12. The compact antenna system of claim 11, wherein the sixth and seventh segments are configured with a cumulative length to transmit/receive radio signals oscillating in the second frequency band of the third network.

13. The compact antenna system of claim 12, wherein:

the first antenna is a dual band PIFA type antenna; and the second antenna is a monopole antenna.

14. The compact antenna system of claim 4, wherein:

the printed circuit board measures approximately 34 mm by approximately 35 mm;

the ground contact is connected to the printed circuit board at the first corner of the printed circuit board and measures approximately 2 mm in width and extends approximately 4.5 mm to offset the first antenna laterally away from the printed circuit board by approximately 4.5 mm;

the feed contact is positioned approximately 1.5 mm away from the ground contact and measures approximately 1.5 mm in width and extends approximately 4.5 mm to offset the first antenna laterally away from the printed circuit board by approximately 4.5 mm;

the first arm measures approximately 29.5 mm by approximately 1.5 mm;

the first segment measures approximately 35 mm by approximately 1.5 mm; and the second segment measures approximately 9.5 mm by approximately 1.5 mm.

15. The compact antenna system of claim 12, wherein:

the printed circuit board measures approximately 34 mm by approximately 35 mm;

the ground contact is connected to the printed circuit board at the first corner of the printed circuit board and measures approximately 2 mm in width and extends approximately 4.5 mm to offset the first antenna laterally away from the printed circuit board by approximately 4.5 mm;

the feed contact is positioned approximately 1.5 mm away from the ground contact and measures approximately 1.5 mm in width and extends approximately 4.5 mm to offset the first antenna laterally away from the printed circuit board by approximately 4.5 mm;

the first antenna measures approximately 29.5 mm by approximately 1.5 mm;

the common segment measures approximately 2 mm by approximately 12 mm;

a first segment of the second arm of the first antenna measures approximately 35 mm by approximately 1.5 mm;

a second segment of the second arm of the first antenna measures approximately 9.5 mm by approximately 1.5 mm;

the third segment measures approximately 2 mm by approximately 37 mm;

the fourth segment measures approximately 18 mm by approximately 2 mm;

the fifth segment measures approximately 2 mm by approximately 38 mm;

the sixth segment measures approximately 4 mm by approximately 10 mm;

the seventh segment measures approximately 2 mm by approximately 27 mm; and the second antenna feed contact is positioned in close proximity to the first antenna feed contact and within approximately 10 mm of the first corner of the printed circuit board.

16. The compact antenna system of claim 1, wherein the first arm is configured in length to transmit/receive radio signals over the first network having a frequency band of 2400 MHz to 2500 MHz and the second arm is configured in length to transmit/receive radio signals over the second network having a frequency band of 1565 MHz to 1610 MHz.

17. The compact antenna system of claim 7, wherein the third arm is configured in length to transmit/receive radio signals of the third network such that the first frequency band is 824 MHz to 960 MHz, and the fourth arm is configured in length to transmit/receive radio signals of the third network such that the second frequency band is 1710 MHz to 2170 MHz.

18. A watch phone, comprising:

a watch housing;

a watch band;

a printed circuit board formed in a first plane and housed within the watch housing;

a first antenna formed in a second plane parallel and laterally offset from the printed circuit board, the first antenna comprising:

a first arm configured in length to transmit/receive radio signals over a first network;

a second arm formed configured in length to transmit/receive radio signals over a second network, wherein the second arm intersects the first arm over a first corner of the printed circuit board and extends perpendicularly away from the first arm;

a feed contact for providing current to the first arm and the second arm, wherein the feed contact is positioned distally away from an edge of the first arm and from an edge of the second arm;

a ground contact for connecting the first arm and the second arm to a grounding plane, wherein the ground contact is positioned proximate to the feed contact and distally away from an edge of the first arm and from an edge of the second arm, wherein the feed contact and the ground contact connect the first antenna to the printed circuit board and are positioned near the first corner of the printed circuit board, and wherein the first antenna is housed within the watch housing.

19. The watch phone of claim 18, wherein the first arm is configured in length to transmit/receive radio signals over a personal area network.

20. The watch phone of claim 18, wherein the second arm is configured in length to transmit/receive radio signals a Global Positioning System (GPS) network.

21. The watch phone of claim 18, wherein the second arm comprises:

a first segment; and a second segment, wherein the first segment intersects the first arm near the first corner of the printed circuit board and extends perpendicularly away from the first arm, wherein the second segment intersects the first segment over a second corner of the printed circuit board and extends perpendicularly away from the first segment, and wherein the first segment and the second segment are configured with a cumulative length to receive radio signals over the second network.

22. The watch phone of claim 18, wherein both the feed contact and the ground contact are configured to extend perpendicularly away from the first plane of the printed circuit board and laterally offset the first antenna from the printed circuit board.

23. The watch phone of claim 22, further comprising:

a second antenna comprising a conductive layer extending beyond an edge of and coplanar with the printed circuit board, the second antenna configured to transmit/receive radio signals over a third network, wherein the second antenna is housed within the watch band; and a second antenna feed contact connecting the second antenna to the printed circuit board.

24. The watch phone of claim 23, wherein the second antenna comprises:

a common segment coupled to the printed circuit board via the second antenna feed contact;

a third arm; and a fourth arm, wherein the third and fourth arms extend from the common segment, with the third arm configured to transmit/receive radio signals of a first frequency band of the third network and the fourth arm of the second antenna configured to transmit/receive radio signals of a second frequency band of the third network.

25. The watch phone of claim 24, wherein the third network is a WWAN network.

26. The watch phone of claim 24, wherein the third arm comprises:

a third segment extending from the common segment away from the printed circuit board;

a fourth segment extending perpendicularly from the third segment; and a fifth segment extending perpendicularly away from the fourth segment and toward the printed circuit board.

27. The watch phone of claim 26, wherein of the third, fourth and fifth segments are configured with a cumulative length to transmit/receive radio signals oscillating in the first frequency band of the third network.

28. The watch phone of claim 24, wherein the fourth arm comprises:

a sixth segment extending perpendicularly away from the common segment; and a seventh segment extending perpendicularly from the sixth segment and away from the printed circuit board.

29. The watch phone of claim 28, wherein the sixth and seventh segments is configured with a cumulative length to transmit/receive radio signals oscillating in the second frequency band of the third network.

30. The watch phone of claim 29, wherein:

the first antenna is a dual band PIFA type antenna; and the second antenna is a monopole antenna.

31. The watch phone of claim 21, wherein:

the printed circuit board measures approximately 34 mm by approximately 35 mm;

the ground contact is connected to the printed circuit board at the first corner of the printed circuit board and measures approximately 2 mm in width and extends approximately 4.5 mm to offset the first antenna laterally away from the printed circuit board by approximately 4.5 mm;

the feed contact is positioned approximately 1.5 mm away from the ground contact and measures approximately 1.5 mm in width and extends approximately 4.5 mm to offset the first antenna laterally away from the printed circuit board by approximately 4.5 mm;

the first antenna measures approximately 29.5 mm by approximately 1.5 mm;

the first segment measures approximately 35 mm by approximately 1.5 mm; and the second segment measures approximately 9.5 mm by approximately 1.5 mm.

32. The watch phone of claim 29, wherein:

the printed circuit board measures approximately 34 mm by approximately 35 mm;

the ground contact is connected to the printed circuit board at the first corner of the printed circuit board and measures approximately 2 mm in width and extends approximately 4.5 mm to offset the first antenna laterally away from the printed circuit board by approximately 4.5 mm;

the feed contact is positioned approximately 1.5 mm away from the ground contact and measures approximately 1.5 mm in width and extends approximately 4.5 mm to offset the first antenna laterally away from the printed circuit board by approximately 4.5 mm;

the first antenna measures approximately 29.5 mm by approximately 1.5 mm;

the common segment measures 2 mm by 12 mm;

a first segment of the second arm of the first antenna measures approximately 35 mm by approximately 1.5 mm;

a second segment of the second arm of the first antenna measures approximately 9.5 mm by approximately 1.5 mm;

the third segment measures approximately 2 mm by approximately 37 mm;

the fourth segment measures approximately 18 mm by approximately 2 mm;

the fifth segment measures approximately 2 mm by approximately 38 mm;

the sixth segment measures approximately 4 mm by approximately 10 mm;

the seventh segment measures approximately 2 mm by approximately 27 mm; and the second antenna feed contact is positioned in close proximity to the first antenna feed contact and within approximately 10 mm of the first corner of the printed circuit board.

33. The watch phone of claim 18, wherein the first arm is configured in length to transmit/receive radio signals over the first network having a frequency band of 2400 MHz to 2500 MHz, and the second arm is configured in length to transmit/receive radio signals over the second network having a frequency band of 1565 MHz to 1610 MHz.

34. The watch phone of claim 24, wherein the third arm is configured in length to transmit/receive radio signals of the third network such that the first frequency band is 824 MHz to 960 MHz, and the fourth arm is configured in length to transmit/receive radio signals of the third network such that the second frequency band is 1710 MHz to 2170 MHz.

* * * * *